US011145200B2

(12) United States Patent
Tonguz et al.

(10) Patent No.: US 11,145,200 B2
(45) Date of Patent: Oct. 12, 2021

(54) SYSTEM AND METHOD FOR VEHICLE-ACTUATED TRAFFIC CONTROL

(71) Applicant: CARNEGIE MELLON UNIVERSITY, Pittsburgh, PA (US)

(72) Inventors: Ozan K. Tonguz, Pittsburgh, PA (US); Rusheng Zhang, Pittsburgh, PA (US)

(73) Assignee: CARNEGIE MELLON UNIVERSITY, Pittsburgh, PA (US)

( * ) Notice: Subject to any disclaimer, the term of this patent is extended or adjusted under 35 U.S.C. 154(b) by 0 days.

(21) Appl. No.: 16/632,467

(22) PCT Filed: Jul. 20, 2018

(86) PCT No.: PCT/US2018/043090

§ 371 (c)(1),
(2) Date: Jan. 20, 2020

(87) PCT Pub. No.: WO2019/018766

PCT Pub. Date: Jan. 24, 2019

(65) Prior Publication Data

US 2020/0211381 A1 Jul. 2, 2020

Related U.S. Application Data

(60) Provisional application No. 62/604,782, filed on Jul. 20, 2017.

(51) Int. Cl.

| | |
|---|---|
| ***G08G 1/087*** | (2006.01) |
| ***G08G 1/01*** | (2006.01) |
| ***G08G 1/08*** | (2006.01) |
| ***G08G 1/083*** | (2006.01) |
| ***G08G 1/095*** | (2006.01) |

(52) U.S. Cl.

CPC ..... *G08G 1/087* (2013.01); *G08G 1/0145* (2013.01); *G08G 1/08* (2013.01); *G08G 1/083* (2013.01); *G08G 1/095* (2013.01)

(58) Field of Classification Search

None

See application file for complete search history.

(56) References Cited

U.S. PATENT DOCUMENTS

| | | | | |
|---|---|---|---|---|
| 6,366,219 | B1 | 4/2002 | Hoummady | |
| 8,050,854 | B1 * | 11/2011 | Chandra | G08G 1/081 701/117 |
| 8,761,991 | B1 * | 6/2014 | Ferguson | G08G 1/096725 701/28 |
| 8,972,159 | B2 | 3/2015 | Ferreira et al. | |

(Continued)

OTHER PUBLICATIONS

International Search and Written Opinion for International application No. PCT/US2018/043090, dated Oct. 25, 2018, 11 pages.

(Continued)

*Primary Examiner* — Thomas S McCormack

(74) *Attorney, Agent, or Firm* — Kacvinsky Daisak Bluni PLLC

(57) ABSTRACT

Systems, methods, algorithms, and software for DSRC-actuated traffic control are presented. The invention leverages the presence of DSRC radios in vehicles and gives priority (by displaying green light) to approaches (roads) that include DSRC-equipped vehicles.

20 Claims, 11 Drawing Sheets

(56) References Cited

U.S. PATENT DOCUMENTS

| | | | | |
|---|---|---|---|---|
| 2003/0210156 | A1* | 11/2003 | Nishimura | G08G 1/08 340/907 |
| 2005/0104745 | A1 | 5/2005 | Bachelder et al. | |
| 2007/0115139 | A1 | 5/2007 | Witte et al. | |
| 2007/0208494 | A1 | 9/2007 | Chapman et al. | |
| 2008/0243388 | A1 | 10/2008 | Eguchi et al. | |
| 2009/0063030 | A1 | 3/2009 | Howarter et al. | |
| 2012/0056756 | A1 | 3/2012 | Yester | |
| 2012/0112928 | A1 | 5/2012 | Nishimura et al. | |
| 2013/0116915 | A1 | 5/2013 | Ferreira et al. | |
| 2013/0304364 | A1 | 11/2013 | Miller et al. | |
| 2014/0278029 | A1 | 9/2014 | Tonguz et al. | |
| 2016/0019784 | A1* | 1/2016 | Peri | G08G 1/017 340/917 |
| 2016/0071418 | A1 | 3/2016 | Oshida et al. | |
| 2017/0110011 | A1 | 4/2017 | Tonguz et al. | |
| 2017/0256167 | A1 | 9/2017 | Kim et al. | |
| 2019/0250639 | A1 | 8/2019 | Xu et al. | |
| 2020/0326203 | A1 | 10/2020 | Lund et al. | |

OTHER PUBLICATIONS

International Search Report and Written Opinion for International application No. PCT/US2018/054604, dated Dec. 21, 2018, 7 pages.
International Search Report and Written Opinion for International application No. PCT/US2018/054504, dated Jan. 16, 2019, 11 pages.

* cited by examiner

SYSTEM AND METHOD FOR VEHICLE-ACTUATED TRAFFIC CONTROL

RELATED APPLICATIONS

This application is a national phase filing under 35 U.S.C. § 371 claiming the benefit of and priority to International Patent Application No. PCT/US2018/043090, filed on Jul. 7, 2018, which claims the benefit of U.S. Provisional Patent Application Ser. No. 62/604,782, filed Jul. 20, 2017.

BACKGROUND

The rapid urbanization in almost every country in the world has exacerbated the traffic congestion problem in urban areas. Especially during rush hours, the delay experienced by commuters keeps increasing. In certain cities (such as Mexico City, Sao Paulo, Rio de Janeiro, Moscow, St. Petersburg, Istanbul, Beijing, Bangkok, New Delhi, Jakarta, etc.) one-way commute times of more than 2 hours is not unusual.

While several factors contribute to traffic congestion, the role of traffic lights in regulating traffic at intersections cannot be underestimated. Infrastructure based traffic lights manage the traffic flow at intersections by deciding the "right of way" between competing flows. Essentially, traffic lights give the right of way to one direction, e.g., the North-South (NS), by displaying green light to vehicles in the NS direction while displaying red light to the vehicles in the orthogonal direction, e.g., the East-West (EW) direction. Note that an intersection having NS/EW roads is used herein only as an exemplar of any intersection having roads in any direction and crossing at any angle.

By displaying a red light to EW direction while displaying a green light to NS direction simultaneously, the safety of the system is ensured. It is this synchronization which prevents collisions or accidents between the vehicles of competing flows at intersections. The cycles in traditional traffic lights are typically governed by a timer. By splitting the cycle duration equally between the NS and EW directions (e.g., 30 s green light to NS and 30 s green light to EW), the "fairness" of the system is also guaranteed.

Unfortunately, this static way of giving the "right of way" to NS and EW directions has been the default mode of operation in the vast majority of traffic lights that have been installed in the last century. While this mode of operation seems fair, it is extremely inefficient as traffic flows are not typically symmetric during most of the day. Hence, it seems logical that the decision mechanism of traffic lights should be aware of the mobility pattern of traffic flows to increase their efficiency.

To achieve this "dynamic" or adaptive approach to giving the right of way is the key problem awaiting solutions. The significance of this problem cannot be underestimated. Recent work on such approaches (e.g., U.S. Pat. No. 8,972,159, entitled "Methods and Systems for Coordinating Vehicular Traffic Using In-Vehicle Virtual Traffic Control Signals Enabled By Vehicle-To-Vehicle Communications") has already shown that, using adaptive traffic control, commute time of urban workers can be reduced by more than 30%.

The "Virtual Traffic Light" (VTL) technology is based on the use of Dedicated Short Range Communications (DSRC) radios within vehicles operating at 5.9 GHz to establish a leader for managing traffic flows at intersections. DSRC technology is based on the well-known 802.11p standard and has been allocated 75 MHz bandwidth in the United States by the Federal Communications Commission. There are 7 channels, one of which serves as a control channel while the other 6 channels serve as service channels. VTL is a self-organizing traffic control scheme as it can eliminate the need for infrastructure-based traffic lights which are expensive to install and maintain. Using VTL technology provide many benefits, including reducing commute time of urban workers by about up to 40%, thus increasing productivity, reducing carbon footprint of vehicles, reducing energy consumption in transportation and enhancing safety at intersections, leading to a greener environment in addition to several other benefits.

However, in most of the developed world (USA, Europe, and some Asian countries), traffic lights are already installed on some of the most densely used routes in cities and, as such, represent a huge investment in infrastructure used for ground transportation. Many governments might therefore be quite reluctant to abandon such a large investment and the infrastructure used for traffic control. Hence, many governments might be much more receptive to the idea of keeping this large infrastructure and upgrading it with certain new technologies to make those traffic lights adaptive and aware of the presence or absence of vehicles in competing flows of an intersection.

While VTL is a very promising new technology leveraging the presence of DSRC radios, one of the issues is the gradual penetration ratio of DSRC technology into vehicles. For ideal operation of VTL technology, all the vehicles at an intersection should be equipped with DSRC radios. Although the U.S. Department of Transportation (DoT), in February of 2014, mandated the use of DSRC radios in vehicles, the adoption of DSRC radios approaching 100% penetration will likely take years, if not decades in the USA, Europe, and Asia. Additionally, current non-DSRC vehicles will also need to be equipped. An interim solution is thus required to improve the efficiency of traffic flow at intersections until 100% penetration of DSRC-equipped vehicles is realized.

SUMMARY

Described herein is a new approach which works with partial penetration (i.e., a small percentage of all vehicles are equipped with DSRC radios) and provides a way of asymptotically approaching the benefits reported for the VTL scheme as the percentage of vehicles equipped with DSRC radios increases.

By installing DSRC receivers at an intersection, traffic lights can be made "intelligent" in decision making, giving priority to approaches (roads) which include vehicles equipped with DSRC radios. The present invention shows that the existence of such radios in vehicles for maximizing traffic flows intersections can be leveraged, even with a very small level of penetration.

To better understand the principle of operation of present invention, consider FIG. 1. This figure shows the finite state machine (FSM) formalism employed in conventional traffic lights. Observe that most traffic lights are timer-based devices. In other words, the right of way is switched from North-South (NS) to East-West (EW) every to seconds (e.g., every 30 s), without any input regarding the dynamics of the traffic flow in either direction.

In contrast, the DSRC-actuated traffic control scheme presented herein is a communications-based traffic control scheme whereby the current state of the traffic light is changed depending on the presence or absence of vehicles in each orthogonal direction. For example, if the NS direction has the green light, the next state will be switched to green light for EW only if DSRC-equipped vehicles are detected in the EW approach. If there are no DSRC-equipped vehicles detected in the EW approach, then the next state will continue to be NS until the green phase time reaches the maximum phase duration. FIG. 2 shows the DSRC-communications based traffic control scheme using FSM formalism.

DETAILED DESCRIPTION

Herein, the systems, algorithms, and other implementation details (including preferred embodiments) of the invention are disclosed.

Figure 3:
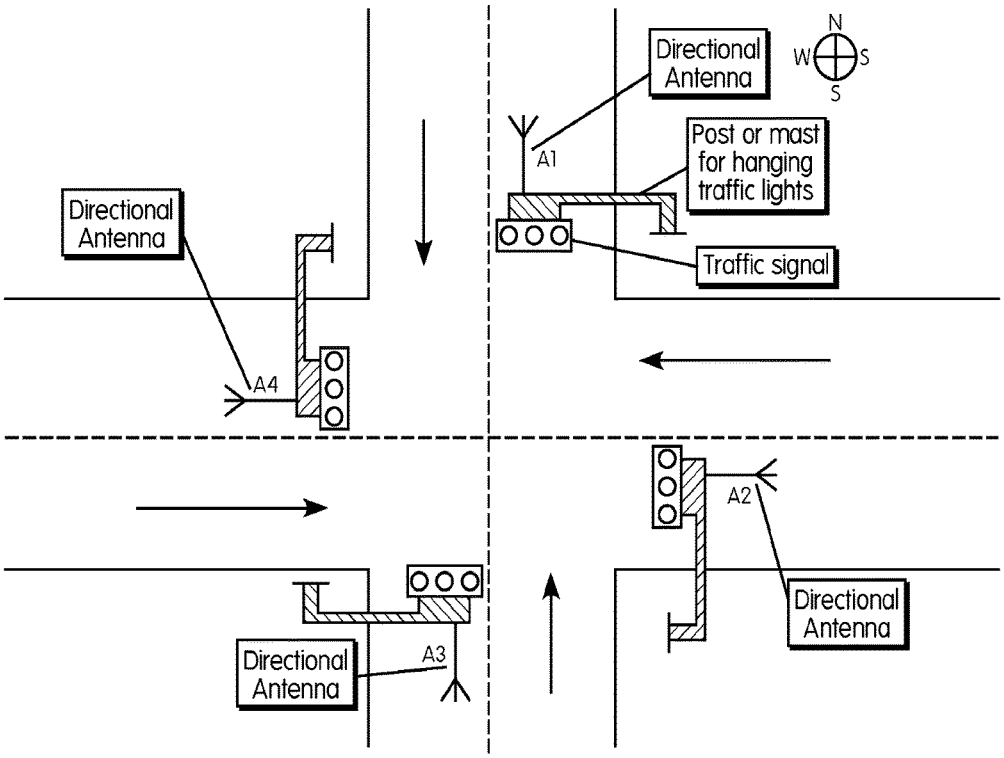
FIG. 3 shows a possible embodiment of the invention at a given intersection.

FIG. 3 shows a possible system embodiment of the proposed DSRC-actuated traffic control scheme. In this embodiment, the installation of directional DSRC receiving antennas on each mast supporting the current traffic lights is required. The function of these antennas is to detect the presence (or absence) of DSRC-equipped vehicles in each approach of the intersection. For example, antenna A3 can be used to detect the DSRC-equipped vehicles approaching the intersection from the South direction, while A1 will be used to detect the presence of DSRC-equipped vehicles approaching the intersection from the North. Similarly, A4 and A2 will be used to detect the presence/absence of vehicles approaching the intersection from the West and East, respectively.

Observe that in this embodiment, the directional antennas placed on the masts supporting the traffic light for that approach only detect DSRC-equipped vehicles in that approach. In other words, DSRC-equipped vehicles on the South-North approach moving Northbound will be detected only by directional antenna A3 whereas the DSRC-equipped vehicles of the North-South approach moving Southbound will be detected only by the directional antenna A1. The same occurs for Eastbound and Westbound approaches using antennas A4 and A2 respectively.

DSRC radios typically send out a beacon signal every 100 ms. In one embodiment, each of the 4 directional antennas are connected to a separate DSRC radio receiver for detecting DSRC-equipped vehicles through the beacon signals.

Figure 4:
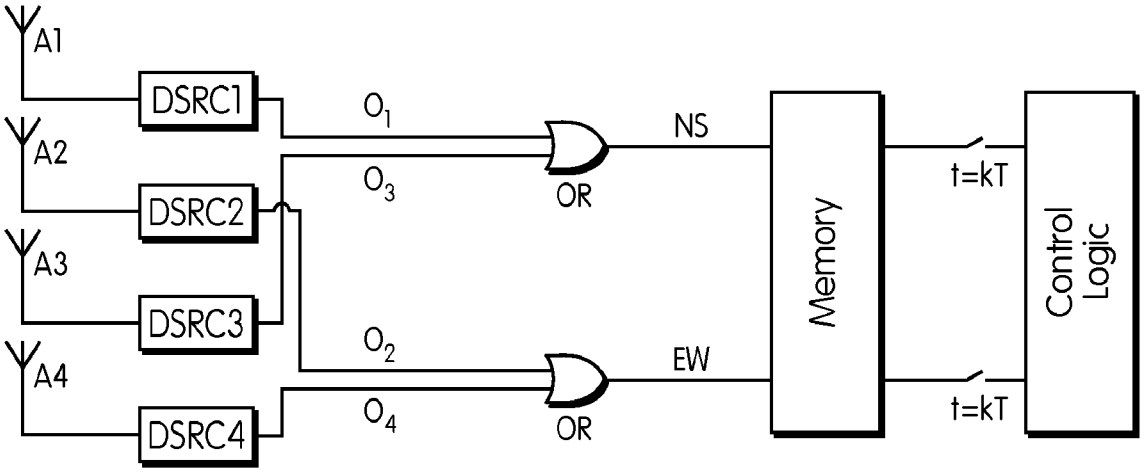
FIG. 4 shows how the information obtained from directional antennae A1, A2, A3, and A4 are utilized by a traffic controller for decision making.

FIG. 4 shows how the information obtained from antennae A1, A2, A3, and A4 are utilized by a traffic controller for decision making. More specifically, this information can be used to decide the next state of the traffic lights at the intersection. Assuming that the decision logic of current traffic lights is in the memory of the control unit, the output of these DSRC receivers are combined using simple Boolean logic which can be implemented in software or using simple hardware flip-flops.

The principle of operation of the DSRC-actuated traffic light depends on both the current state of the traffic light and the output of the DSRC receivers, denoted as 01, 02, 03, and 04 (indicating the presence or absence of a DSRC-equipped vehicle waiting at or approaching the intersection) in FIG. 4. Note that to avoid trapping non-DSRC-equipped vehicles that the intersection, the DSRC logic provides each pair of traffic lights (i.e., the NS pair and the EW pair) with a timing mechanism consisting of a minimum duration cycle and a maximum duration cycle. The minimum and maximum durations of the cycles need not be equal for the NS and EW pairs, and may be dynamically adjusted based on, for example, the time of day or the number of observed DSRC-equipped vehicles on either road of the intersection.

As a specific example, assume that the EW approaches currently have the green light. If antennas A1 or A3 detect any beacon messages indicating the presence of DSRC-equipped vehicles in the orthogonal NS approaches, then the next state of the traffic light will be switched to display green light to NS direction. Otherwise, green light for EW will continue irrespective of the fact that it was already green in the last T seconds (the sampling time, e.g., 5 sec.). This is in stark contrast to the current principle of operation of traffic lights which is timer-based.

As shown in FIG. 4, the detected beacon messages of DSRC-equipped vehicles are combined in a specific manner to inform the traffic light whether of the presence of DSRC-equipped vehicles in the orthogonal direction when the traffic light is in a given state. For example, when the current state displays the green light for the EW and WE approaches, then the system detects whether there are any DSRC-equipped vehicles in the orthogonal NS or SN directions. This information is coming from antennas A3 and A1, respectively. By performing a logical OR operation, it is detected whether there are any DSRC-equipped vehicles either in the NS or SN approaches. If so, the next state of light will be green for the NS and SN approaches. If not, then the green light for EW and WE will continue.

Table 1 shows the Boolean truth table which summarizes the principle of operation of the new DSRC-actuated traffic control scheme. Observe that in Table 1, 01, 02, 03, and 04 are Boolean variables and they can only take on the binary values of 0 or 1. In this notation, the binary value 0 corresponds to no DSRC-equipped vehicles being detected whereas the binary value 1 corresponds to detecting one or several DSRC-equipped vehicles. The truth table shows the possible transitions from current state the next state when the current phase timing is $t_{min}<t<t_{max}$, where $t_{min}$ denotes the minimum phase timing requirement, $t_{max}$ denotes the maximum phase timing, and t is the current time that has lapsed from the beginning of the phase. Here, $NS_G$ denotes green light for North-South direction while $EW_G$ denotes green light for East-West direction. As previously stated, the $t_{min}$ and $t_{max}$ for each phase may be different for the NS and EW directions of travel and may be adjustable.

TABLE 1

| Current State | Next State | $O_1$ | $O_2$ | $O_3$ | $O_4$ |
|---|---|---|---|---|---|
| $NS_G$ | $NS_G$ | 0 | 0 | 0 | 0 |
| $NS_G$ | $EW_G$ | 0 | 0 | 0 | 1 |
| $NS_G$ | $EW_G$ | 0 | 1 | 0 | 0 |
| $NS_G$ | $NS_G$ | 1 | 0/1 | 0/1 | 0/1 |
| $NS_G$ | $NS_G$ | 0/1 | 0/1 | 1 | 0/1 |
| $EW_G$ | $EW_G$ | 0 | 0 | 0 | 0 |
| $EW_G$ | $NS_G$ | 1 | 0 | 0 | 0 |
| $EW_G$ | $NS_G$ | 0 | 0 | 1 | 0 |
| $EW_G$ | $EW_G$ | 0/1 | 1 | 0/1 | 0/1 |
| $EW_G$ | $EW_G$ | 0/1 | 0/1 | 0/1 | 1 |

Figure 1:
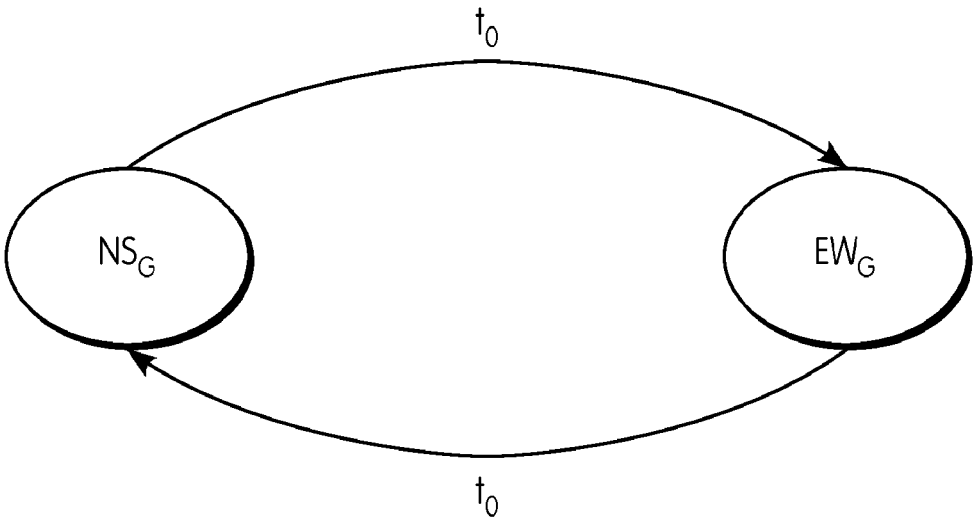
FIG. 1 (Prior Art)
FIG. 1 shows an FSM representation of the principle of operation of current traffic lights
Figure 2:
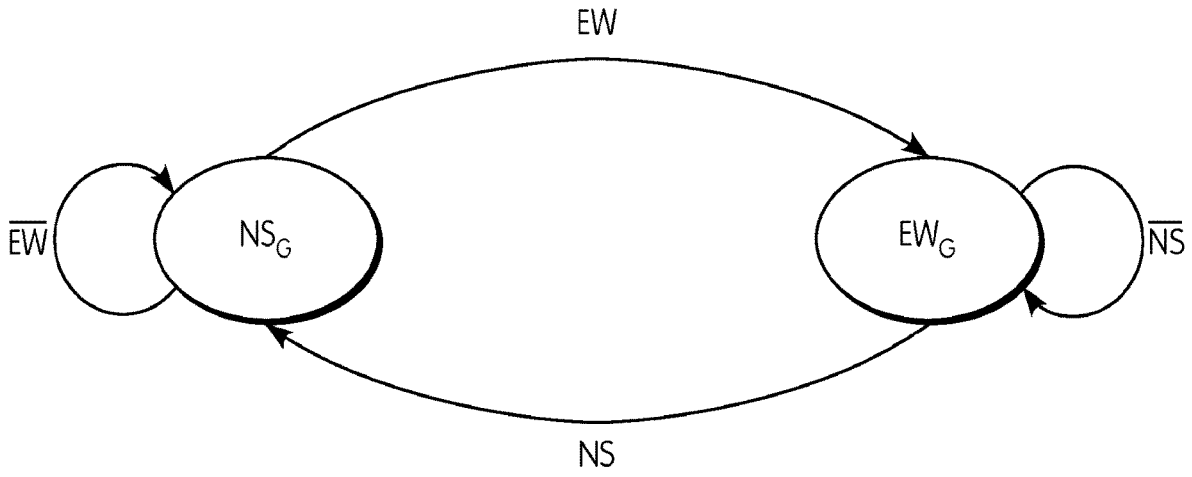
FIG. 2 shows an FSM representation of the operation of the proposed DSRC-actuated traffic lights.
Figure 5:
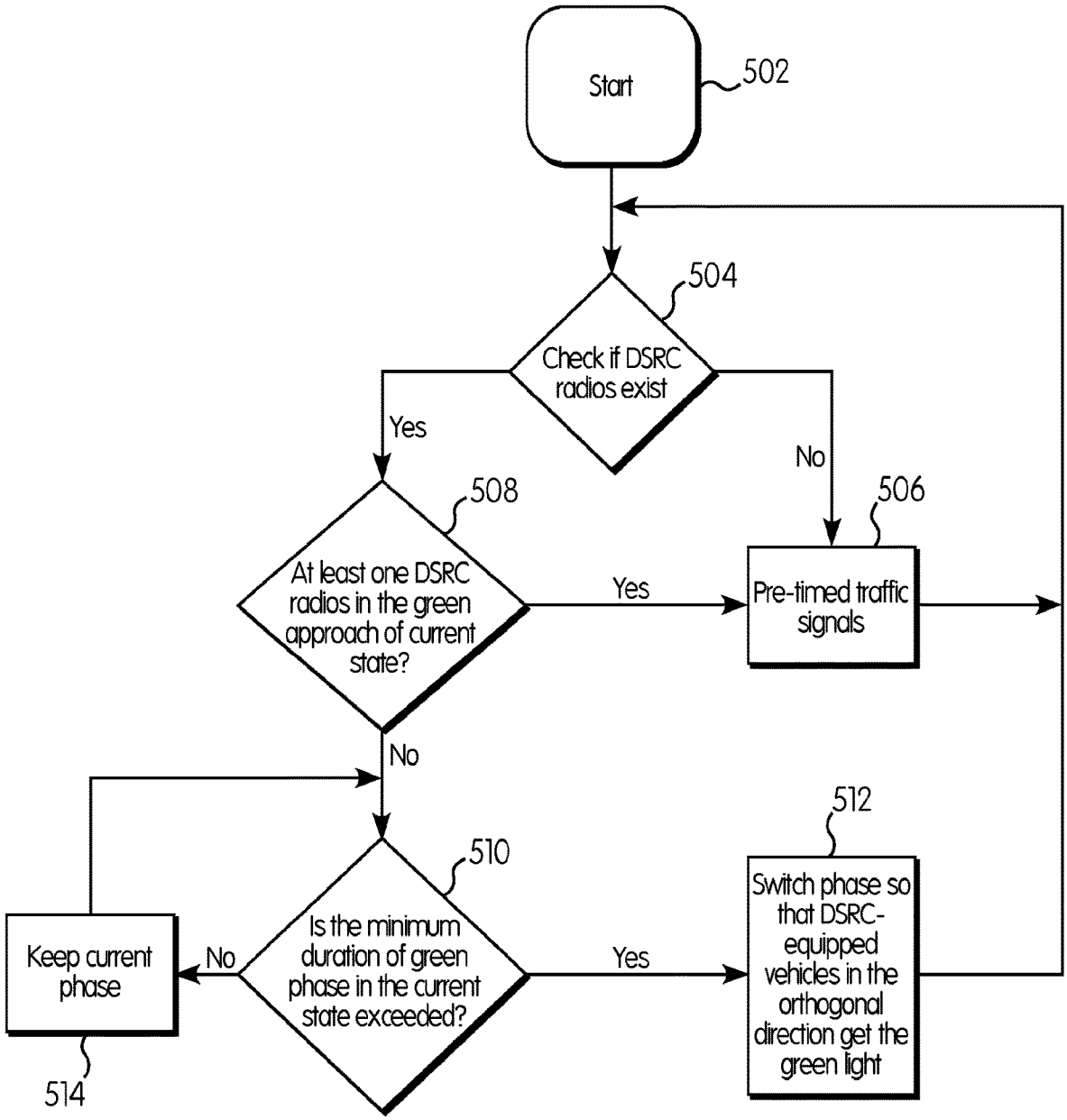
FIG. 5 is a flow chart showing the overall principle of operations of the DSRC-actuated traffic control scheme.

FIG. 5 shows the overall principle of operations of the DSRC-actuated traffic control scheme as a flow chart. Operation starts at 502, and, at 504, a check is made for the presence of any DSRC-equipped vehicles, either at or approaching an intersection. If no DSRC radios are detected, then the method returns, at 506, to the original, pre-timed traffic signal mode of operation, shown in FIG. 1, where each phase of the cycle will last for a $t_{max}$ number of seconds, which may be different for the NS and EW directions.

If, on the other hand, the system detects the presence of DSRC-equipped vehicles at 504, it then checks, at 508, whether the detected DSRC-equipped vehicles are on the approach that currently has the green light. If so, then the algorithm moves to the pre-timed operation mode at 506 where the green split between the orthogonal directions is dependent on timers and will last for a maximum of $t_{max}$ seconds. If not, then this implies that the DSRC-equipped vehicles are in the orthogonal direction that currently has the red phase. In this case, the system checks, at 510 whether the current time that has lapsed for the current phase is larger than the minimum time ($t_{min}$) allowed for the green phase. If so, then switching occurs at 512 and the orthogonal approach that includes the DSRC-equipped vehicles gets the green phase. If not, the green phase of the current state is maintained at 514 until the minimum time required for switching is satisfied, at which point the switching occurs at 512 and the green phase is given to the orthogonal direction.

Overall, it is important to emphasize that when there are no DSRC-equipped vehicles detected, the system operation reduces to the current principle of timer-based operation of existing traffic lights. However, the system behaves in a completely different manner when it detects the presence of DSRC-equipped vehicles, essentially giving priority to the approaches that include DSRC-equipped vehicles. As shown below, this reduces the commute time of not only DSRC-equipped vehicles but also unequipped vehicles, and the average commute time of all vehicles is thereby reduced.

The performance of the proposed invention has been simulated. The performance at a single intersection was quantified, and the analysis was then extended to multiple intersections to quantify the improvement in commute time. Subsequently, the results were also quantified for rush-hour traffic. Finally, the overall performance of the DSRC-actuated traffic control system during a whole day was analyzed.

Figure 6:
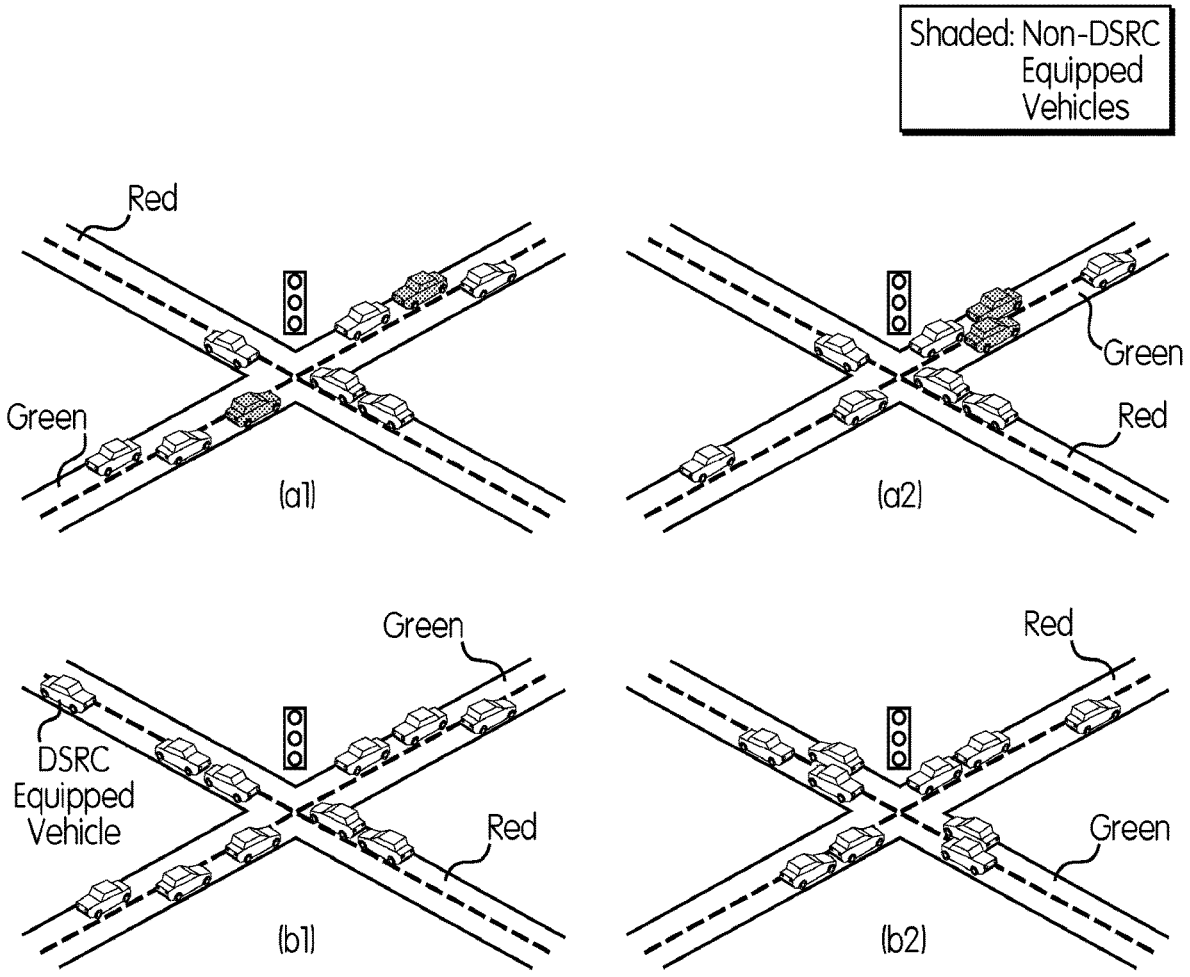
FIG. 6 shows such a single intersection with 2-lane traffic in each approach.

FIG. 6 shows such a single intersection with 2-lane traffic in each approach. Assuming an arrival rate of 1500 cars/hr., the waiting time of the DSRC-actuated traffic control scheme is quantified. To provide a detailed analysis, the waiting time for DSRC-quipped and unequipped vehicles are given in addition to the overall system performance of DSRC-actuated traffic control system. To put things in perspective, the performance of current traffic lights (TL) and VTL system are also provided which allows a more meaningful comparison which, in turn, leads to a better understanding of the benefits of the invented system as a function of the percentage of DSRC-equipped vehicles (penetration rate).

Figure 7:
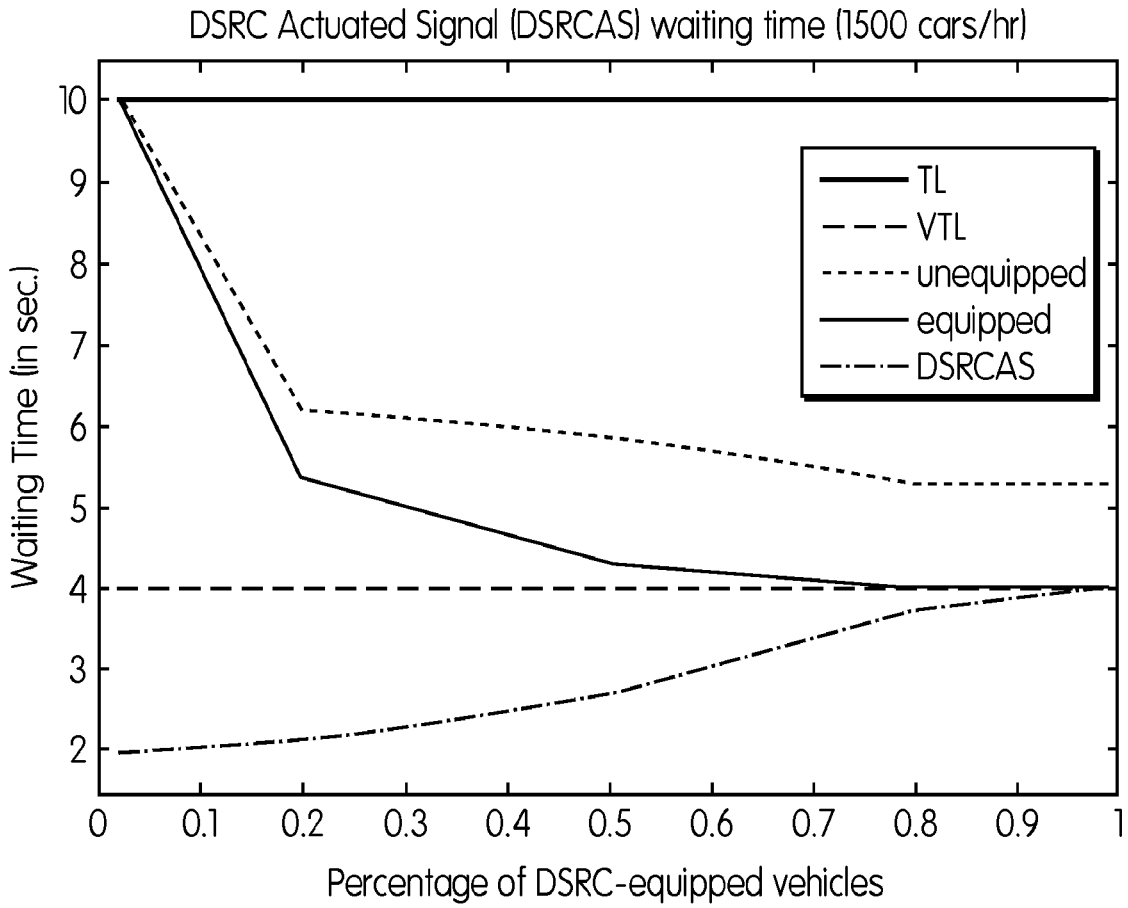
FIG. 7 shows the results of the simulations obtained with a large-scale simulator.

As shown in FIG. 6, (a1) to (a2) no switching occurs as the orthogonal direction has no DSRC-equipped vehicles (the blue vehicles). From (b1) to (b2), however, switching of green light occurs as the orthogonal direction has one DSRC equipped vehicle FIG. 7 shows the performance of the system as simulated using a large-scale simulator in terms of Average Waiting Time as a function of the percentage of DSRC-equipped vehicles. For comparison, the average waiting time of regular traffic lights (TL) and Virtual Traffic Lights (VTL) is also shown. For the single intersection considered, observe that the VTL system reduces the average waiting time at the intersection from 10 s to 4 s, which corresponds to 60% benefit. This is in line with several previous results reported about the benefit of VTL. As expected, the overall system performance of the DSRC-actuated Traffic Control System asymptotically approaches the performance of VTL system as the penetration level increases. It should be noted that even the performance of the unequipped vehicles (the magenta line in the graph) improves. This is based on fact that, even at low penetration rates (such as 20%), in each approach there might be (with finite probability) a few DSRC-equipped vehicles, and, if not, the vehicles and no worse off than with the present system. Hence, after their presence is detected, that approach gets the green light. Observe that when that approach gets the green light, even the unequipped vehicles benefit from this even though they are not equipped with DSRC radios. This is the main reason behind the better performance of unequipped vehicles using the DSRC traffic control system of the present invention as opposed to the current traffic light system, denoted as TL in FIG. 7. Clearly, when only the performance of DSRC-equipped vehicles is considered, because at an intersection they always get priority, it is not surprising that their performance is even better than VTL. Of course, this provides a compelling reason and motivation for using DSRC radios in vehicles.

Figure 8:
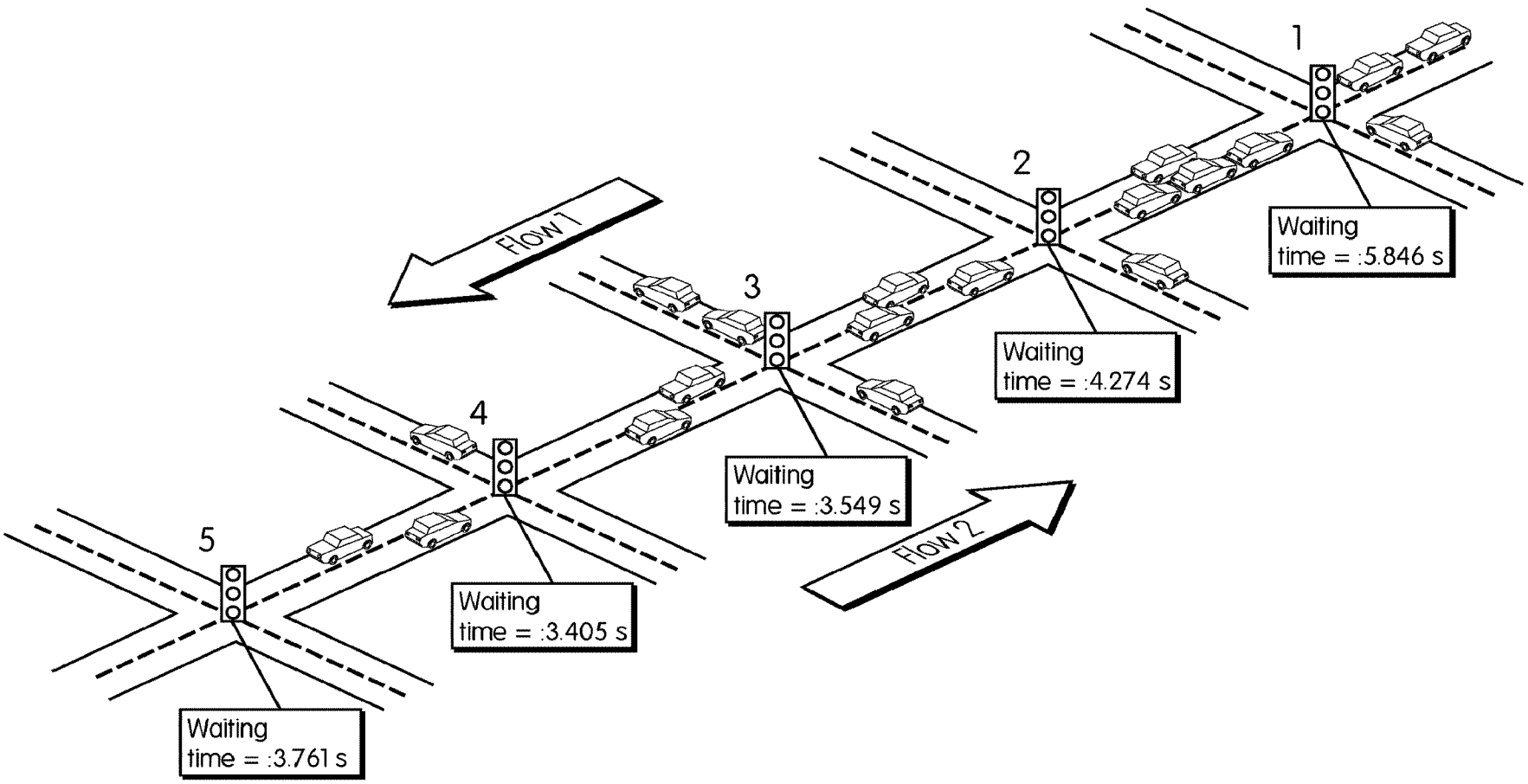
FIG. 8 shows the results if simulations for multiple intersections, showing the average waiting time performance at every intersection on an arterial road of 10 intersections.

While the results in FIG. 7 show improved efficiency using the DSRC-actuated traffic control system in an urban area, the typical route followed by vehicles may involve several intersections. FIG. 8 shows such a scenario, showing the average waiting tune performance at every intersection on an arterial road of 10 intersections. Here, it is assumed that Flow 1 and Flow 2 are compatible, which corresponds to non-rush hour traffic conditions in a city. The core node for measuring the performance is intersection 5 due to the symmetry of flows. Observe that the average waiting time stabilizes around 3rd intersection.

The scenario considered in FIG. 8 involves a total of 10 intersections (due to symmetry, the intersections 6-10 are not shown in the figure). It is also assumed that the intensity of Flow 1 and Flow 2 in this arterial road are approximately equal, which typically may correspond to non-rush hour traffic during a day (e.g., between 10 AM and 3 PM). Because of these assumptions, the "core node" which seems to be the most suitable for measuring the performance of the DSRC-actuated traffic control system is intersection #5. The ratio of the traffic flow on the main artery to side flows is assumed to be 4:1. In addition, an arrival rate of 1500 cars/hr. is assumed. Observe from FIG. 7 that the average waiting time of the DSRC-actuated traffic control system improves as vehicles move from Intersection 1 to intersections 2, 3, etc. Around Intersection 3, the average waiting time converges to 3.5 seconds asymptotically. For this scenario, a vehicle entering the arterial road as part of Flow 1 will cross intersection 5 after waiting 5.85 s+4.27 s+3.55 s+3.4 s+3.76 s=20.83 s. When this is contrasted with current traffic light systems, the same vehicle would have to wait about 10 s+10 s+10 s+10 s+10 s=50 s.

Hence, the improvement on efficiency with the present invention amounts to about 60% in terms of waiting time. Even when the time to travel is considered, the physical distance from the 1st intersection to the 5th intersection, the DSRC-actuated traffic control system provides a benefit of about 30%. This assumes a speed of 11 m/s (25 mph) and a block size of about 125 m. When the total number of intersections on the arterial road exceeds 10 intersections, then the overall benefit is larger than 40%.

To show the performance of the present invention during rush-hours, additional simulations were run. The details of the scenario considered in the simulations was as follows: Assume an arterial road with 5 intersections and a major car flow on the arterial road (i.e., traffic in one direction during rush hour will be dominant compared to the other direction). The traffic crossing the arterial road will contribute a small amount to the total car flow. In the simulations, the ratio of arterial car flow to orthogonal (crossing the arterial road) car flow is assumed to be 5:1.

In the simulations, the car flow was gradually increased for the DSRC-actuated traffic intersections. At around 3200 cars/hr., the system approaches saturation. It is interesting to observe that the new system with DSRC-actuated intersections becomes half-full after 600 seconds; i.e., when t=600 s, and completely full when t=1800 s (i.e., after 30 min). Hence, the simulation time was set as 30 min and repeated 3 times. The results of the simulations were recorded. To make a fair and meaningful comparison, the same car flow and topology for normal traffic lights (TL) were used and the offset values between 5 intersections were randomly set. The results obtained are shown in Table 2.

TABLE 2

| | Experiment Number | | | |
|---|---|---|---|---|
| | 1 | 2 | 3 | Average |
| Traffic Lights | 330.64 s | 260.65 s | 429.50 s | 340.26 s |
| DSRC-Actuated Traffic Lights | 186.70 s | 181.23 s | 184.56 s | 184.16 s |

As shown, the average commute time of DSRC-actuated traffic lights is 184.16 s, while the average commute time of regular Traffic Lights is 340.26 s. This corresponds to a significant improvement of about 46%.

As another performance metric, the performance of the present invention has also been measured in terms of the system output rate, in vehicles/s, over a period of 30 min. The results obtained are shown below in Table 3.

TABLE 3

| Time Interval (sec) | | 0-600 | 600-1200 | 1200-1800 |
|---|---|---|---|---|
| Traffic Lights | Experiment #1 | 0.443 | 0.560 | 0.512 |
| | Experiment #2 | 0.467 | 0.592 | 0.548 |
| | Experiment #3 | 0.440 | 0.570 | 0.520 |

TABLE 3-continued

| Time Interval (sec) | | 0-600 | 600-1200 | 1200-1800 |
|---|---|---|---|---|
| DSRC-Actuated Traffic Light | Experiment #1 | 0.558 | 0.687 | 0.693 |
| | Experiment #2 | 0.565 | 0.680 | 0.745 |
| | Experiment #3 | 0.566 | 0.683 | 0.732 |

As mentioned before, the period between 0-600 seconds corresponds to the regime when the arterial road becomes half-full at t=600 s, whereas the period 1200-1800 sec corresponds to the period when the arterial road becomes full slightly before 1800 s. The results in Table 3 show that the present invention provides an improvement of about 37.5% in terms of system output rate when the system gets congested. The same benefit is about 25% when the system is half-full.

After quantifying the performance of the present invention during rush hours and non-rush hours, the simulations were extended to a larger arterial road with 24 intersections, which corresponds to an urban road segment of 3 km. The main purpose of using this new scenario is to quantify the overall performance of a more realistic and significant route in urban areas throughout the day.

For this new scenario, it is assumed that 20% of vehicles are equipped with DSRC radios. It is also assumed that during the rush hour, 5 of these 24 intersections will be in congested mode while the others are under heavy flow but not congested. Furthermore, it is assumed that drivers will have to drive on and off the arterial road and go through some un-signaled intersections. Assuming this time to be 2 minutes during non-rush hours (i.e., between 10 AM-3 PM), 1 minute for midnight, and 5 minutes for rush hours, the results obtained are shown in Table 4.

TABLE 4

| | 7-9 AM & 4-6 PM (rush hour) | 9 AM-4 PM | 8 PM-6 AM |
|---|---|---|---|
| DSRC - Actuated Traffic Lights | 14.2 min | 8.8 min | 8.9 min |
| DSRC-Equipped Vehicles | 13.8 min | 8.1 min | 5.68 min |
| Unequipped Vehicles | 14.3 min | 9.3 min | 9.7 min |
| Regular Traffic Lights | 22.0 min | 12.2 min | 9.7 min |

Figure 9:
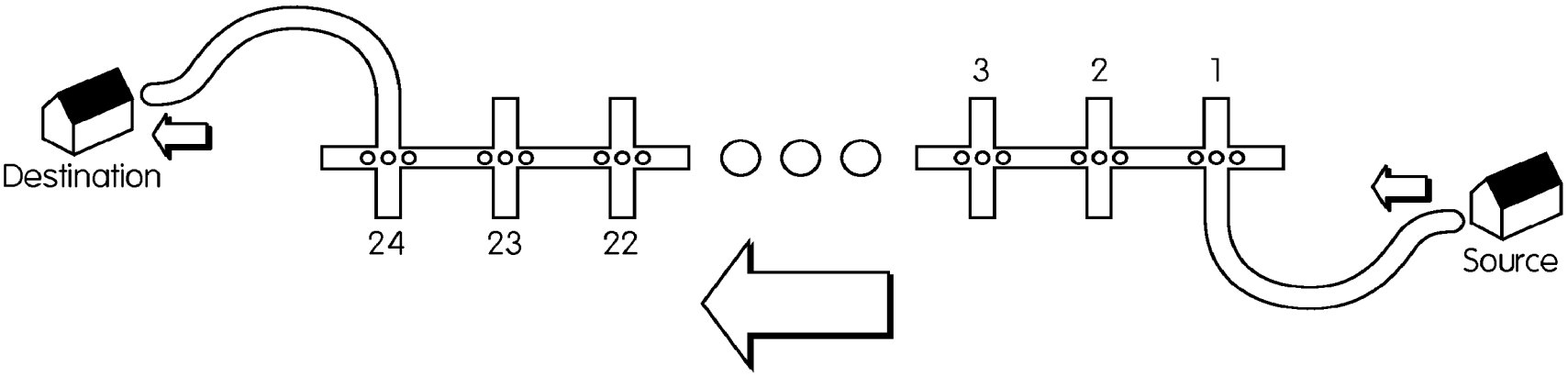
FIG. 9 shows a scenario having an artery with 24 intersections with a source and destination.

FIG. 9 shows the scenario having an artery with 24 intersections, 3 km long, with a source and destination. For most cities this would be considered a significant route segment within the city. The benefit of the invented system and the underlying trends are quantified for the whole day. which involves three different regimes.

Table 4 shows that the benefit of the invented system during rush hours (i.e., between 7 AM-9 AM and 4 PM-6 PM) is about 35.5%, during the non-rush hour period of 10 AM-4 PM, the benefit of DSRC-actuated new system is about 27.8%. Finally, in the third regime that encompasses the period of 8 PM to 6 AM, the benefit of the invented system is about 8.3%.

One of the preferred embodiments of the disclosed invention is depicted in FIG. 3. In this embodiment, four directional antennas are placed on the masts holding or supporting the current traffic lights. While the underlying geometry could vary from intersection to intersection, placing the antennas on the 4 masts could be a viable solution. These antennas are then connected to their corresponding DSRC receiver (one DSRC receiver per antenna) through some wiring. In one embodiment, it is possible to put these 4 DSRC receivers (essentially DSRC transceiver chips) with all the associated electronics and control circuitry onto a single board and place this board as a "line card" into the detector module of current traffic light control boxes that exist at every intersection equipped with traffic lights.

Figure 10:
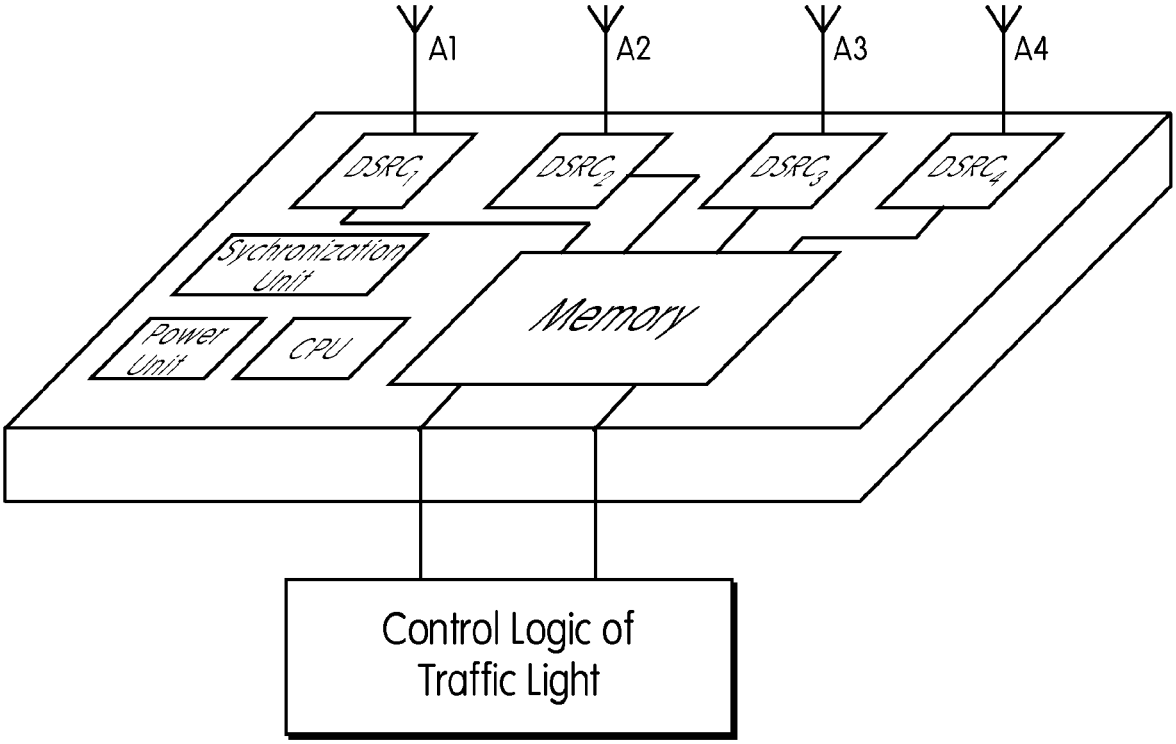
FIG. 10 shows an example of a single-card embodiment of the invention.

FIG. 10 shows a possible embodiment in which the DSRC receivers are contained on a single circuit board, which may be disposed in the traffic light control box. FIG. 10 shows the single board having 4 DSRC radio transceivers (chips), a memory unit, a power unit, a synchronization unit, and a CPU, in addition to all the other necessary electronics. It should be noted that the invention should work at intersections with any number of roads, and is not meant to be limited to intersections with 2 intersecting roads. Additionally, the invention is also effective at "T" intersections.

This single card embodiment is very attractive as the bulk of the solution can be placed into the control box that exists at every traffic light in a very non-invasive manner, with only the antennae being outside of the box. This minimizes the additional equipment that will be installed on the outside masts or traffic lights.

Other embodiments are also possible. For example, due to the bandwidth and attenuation characteristics of the wires or cables used to connect the antennas to DSRC radios, it may be necessary to use down-converters (microwave mixers) to bring down the frequency of the beacon signals arriving at 5.9 GHz to a level that can be transmitted or carried by the wiring used (e.g., twisted pair, coaxial cable, etc.).

Figure 11:
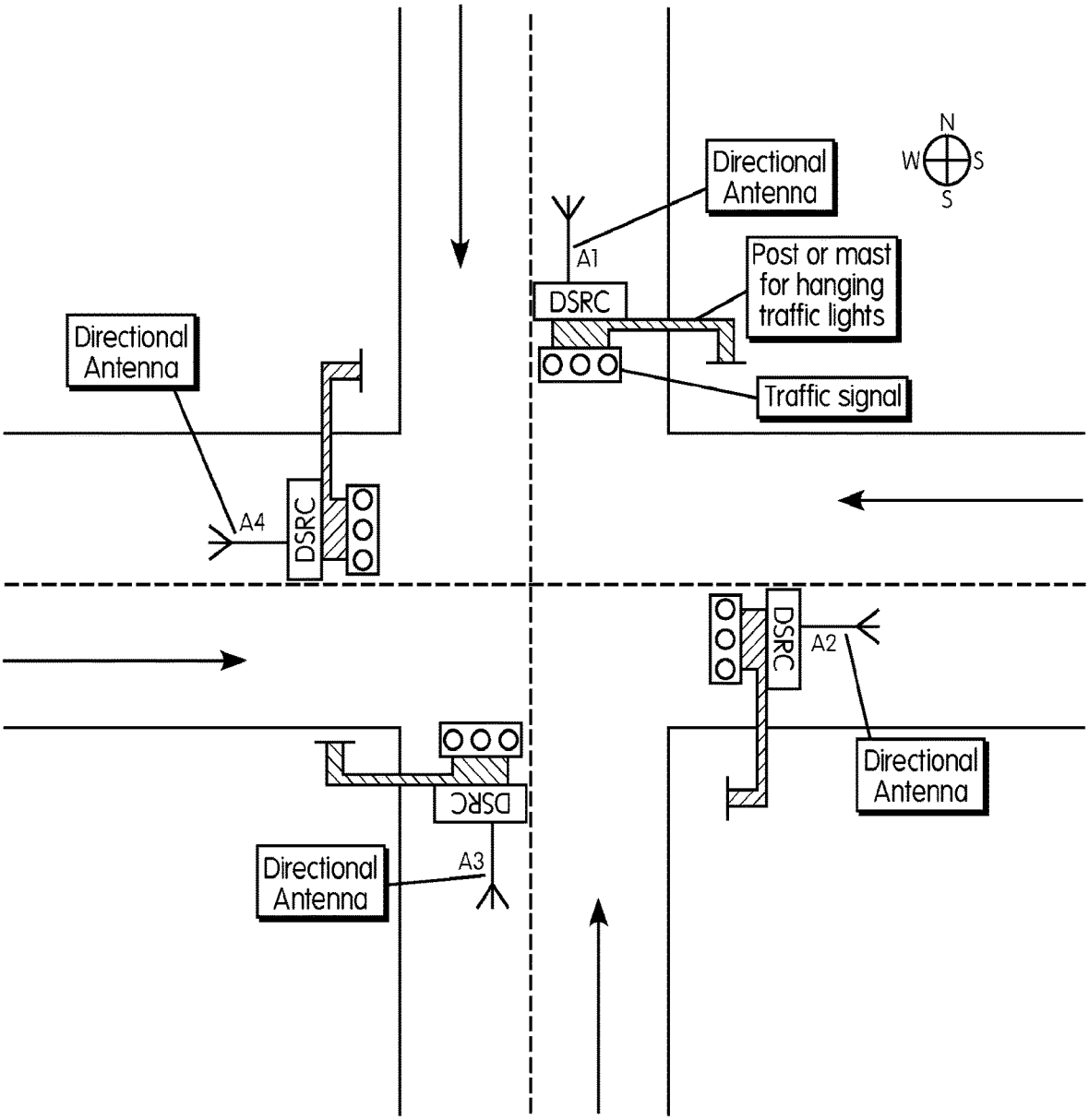
FIG. 11 shows an alternate embodiment in which the DSRC receivers are placed on the masts of an intersection supporting the existing traffic signals.

FIG. 11 shows yet another embodiment in which the DSRC receivers are placed on each mast of an intersection, near the mounting point of the antenna and the processing in each of these DSRC-receivers occurs outside of the traffic light control box. After the presence/absence of DSRC-equipped vehicles is detected, this information can be transmitted to the decision logic inside the traffic light control box in binary format as a Boolean variable (0 denoting no DSRC-equipped vehicle detected and 1 denoting the presence of one or more DSRC-equipped vehicles in each of the four approaches).

Other alternate embodiments exist. For example, in one embodiment, a wired connection (e.g., twisted pair, coaxial cable, fiber, etc.) is used between the directional antennas and the traffic light control box, where the single card embodiment in installed. In the other preferred embodiment depicted in FIG. 11, wired connections between DSRC radios and the control logic of traffic lights are shown. It should be clear that such connections could also be implemented using wireless technologies (such as 802.11 a, ac, b, g, CDMA, 3G, 4G, SG, etc.). Such embodiments are clearly possible and they should be straightforward to implement following the teachings of our invention.

Similarly, while the herein invention is described using DSRC radios operating at the center frequency of 5.9 GHz for the wireless communications between the DSRC radios installed within the vehicles approaching an intersection and the DSRC radios installed at the intersection for detecting the presence of DSRC-equipped vehicles, the same invention could be implemented using any other wireless technology, for example, WiFi, 2G, 3G, 4G, SG, etc.) operating at different center frequencies (such as 2.4 GHz). Such different embodiments are meant to be included within the scope of the invention.

While the preferred embodiments employ directional antennas at the intersections for detecting the presence of DSRC-equipped vehicles, with appropriate modifications in the design, the use of omnidirectional antennas for the DSRC radios used at the intersection is also possible and is meant to be included within the scope of the invention. In an alternate embodiment, a single DRSC radio can be used as the receiver for all approaches to the intersection. Similarly, while the preferred embodiments already disclosed use omnidirectional antennas for the DSRC radios within the vehicles, in other embodiments, using directional antennas for the DSRC radios within vehicles is also possible and should be obvious. Such different embodiments (as well as many other possible embodiments) are all included within the scope of the invention.

Other alternations or deviations from the example embodiments provided herein are possible while remaining within the scope of the invention, which is captured in the following claims.

We claim:

1. A method comprising:

receiving, at an intersection of a first road and a second road, a first wireless signal transmitted by a first vehicle;

determining, based on the first wireless signal, that the first vehicle is approaching the intersection on the first road;

determining that a first traffic signal controlling traffic on the first road is red and a second traffic signal controlling traffic on the second road is green;

determining that no wireless signals have been received from vehicles approaching the intersection on the second road;

determining that the second traffic signal has been green for a minimum time; and switching the first traffic signal to green and the second traffic signal to red.

2. The method of claim 1, further comprising:

receiving, at the intersection, a second wireless signal transmitted by a second vehicle;

determining, based on the second wireless signal, that the second vehicle is approaching the intersection on the second road;

determining that the first traffic signal is green and the second traffic signal is red;

receiving, at the intersection, a third wireless signal transmitted by a third vehicle;

determining, based on the third wireless signal, that the third vehicle is approaching the intersection on the first road;

determining that the first traffic signal has been green for less than a maximum time; and keeping the first traffic signal green and the second traffic signal red until the maximum time for the first traffic signal has been reached; and switching the first traffic signal to red and the second traffic signal to green when the maximum time for the first traffic signal has been reached.

3. The method of claim 2 wherein:

the first and second roads each have a maximum time and minimum time.

4. The method of claim 3 wherein the maximum time and minimum time for each road are adjusted dynamically.

5. The method of claim 4 wherein the maximum time and minimum time for each road are adjusted dynamically based on the time of day or the number of wireless signals received at the intersection.

6. The method of claim 2 wherein the first, second and third vehicles are equipped with DSRC-compatible transmitters and further wherein one or more DSRC-compatible receivers are present at the intersection of the first and second roads to receive wireless signals from one or more vehicles approaching the intersection.

7. The method of claim 2 wherein the steps of the method are iteratively performed.

8. A system comprising:

one or more wireless receivers located at an intersection of a first road and a second road, each wireless receiver having an antenna connected thereto to receive wireless signals from vehicles approaching the intersection on the first road or the second road; and a logic controller, connected to the plurality of wireless receivers, the logic controller implementing the functions of:

receiving, at the intersection, a first wireless signal transmitted by a first vehicle;

determining, based on the first wireless signal, that the first vehicle is approaching the intersection on the first road;

determining that a first traffic signal controlling traffic on the first road is red and a second traffic signal controlling traffic on the second road is green;

determining that no wireless signals have been received from vehicles approaching the intersection on the second road;

determining that the second traffic signal has been green for a minimum time; and switching the first traffic signal to green and the second traffic signal to red.

9. The system of claim 8, the logic controller implementing the further functions of:

receiving, at the intersection, a second wireless signal transmitted by a second vehicle;

determining, based on the second wireless signal, that the second vehicle is approaching the intersection on the second road;

determining that the first traffic signal is green and the second traffic signal is red;

receiving, at the intersection, a third wireless signal transmitted by a third vehicle;

determining, based on the third wireless signal, that the third vehicle is approaching the intersection on the first road;

determining that the first traffic signal has been green for less than a maximum time; and keeping the first traffic signal green and the second traffic signal red until the maximum time for the first traffic signal has been reached; and switching the first traffic signal to red and the second traffic signal to green when the maximum time for the first traffic signal has been reached.

10. The system of claim 9 wherein:

the first and second roads each have a maximum time and a minimum time.

11. The system of claim 10 wherein the maximum time and minimum time for each road are adjusted dynamically.

12. The system of claim 11 wherein the maximum time and minimum time for each road are adjusted dynamically based on the time of day or the number of wireless signals received at the intersection.

13. The system of claim 9 wherein the first, second and third vehicles are equipped with DSRC-compatible transmitters and further wherein the one or more wireless receivers are DSRC-compatible receivers to receive wireless signals from one or more vehicles approaching the intersection.

14. The system of claim 9 wherein the logic functions are iteratively performed.

15. An apparatus comprising:

one or more DSRC-compatible wireless receivers; and a logic board comprising:

a processor; and a non-transitory, computer-readable storage medium storing logic that, when executed by the processor, causes the processor to perform the functions of:

receiving, at an intersection of a first road and a second road, a wireless signal transmitted by a first vehicle;

determining, based on the first wireless signal, that the first vehicle is approaching the intersection on the first road;

determining that a first traffic signal controlling traffic on the first road is red and a second traffic signal controlling traffic on the second road is green;

determining that no wireless signals have been received from vehicles approaching the intersection on the second road;

determining that the second traffic signal has been green for a minimum time; and switching the first traffic signal to green and the second traffic signal to red.

16. The apparatus of claim 15, medium storing further logic causing the processor to perform the further functions of:

receiving, at the intersection, a second wireless signal transmitted by a second vehicle;

determining, based on the second wireless signal, that the second vehicle is approaching the intersection on the second road;

determining that the first traffic signal is green and the second traffic signal is red;

receiving, at the intersection, a third wireless signal transmitted by a third vehicle;

determining, based on the third wireless signal, that the third vehicle is approaching the intersection on the first road;

determining that the first traffic signal has been green for less than a maximum time; and keeping the first traffic signal green and the second traffic signal red until the maximum time for the first traffic signal has been reached; and switching the first traffic signal to red and the second traffic signal to green when the maximum time for the first traffic signal has been reached.

17. The apparatus of claim 16 wherein the first and second roads each have a maximum time and minimum time.

18. The apparatus of claim 17 wherein the maximum time and minimum time for each road are dynamically adjusted based on the time of day or the number of wireless signals received at the intersection.

19. The apparatus of claim 17 wherein the first, second and third vehicles are equipped with DSRC-compatible transmitters and further wherein the first, second, or third wireless signals indicating the presence of a vehicle approaching the intersection on the first or second roads respectively may be received from vehicles approaching the intersection from either direction of travel on the first or second roads.

20. The apparatus of claim 17 wherein the functions performed by the processor are iteratively performed.

* * * * *